US007123193B2

(12) United States Patent
Velve

(10) Patent No.: US 7,123,193 B2
(45) Date of Patent: Oct. 17, 2006

(54) VERTICALLY-ORIENTED SATELLITE ANTENNA

(76) Inventor: Per Velve, Brennmyrasen 7, Tjodalyng N-3280 (NO)

( * ) Notice: Subject to any disclaimer, the term of this patent is extended or adjusted under 35 U.S.C. 154(b) by 0 days.

(21) Appl. No.: 10/506,498

(22) PCT Filed: Mar. 6, 2002

(86) PCT No.: PCT/NO02/00092

§ 371 (c)(1),
(2), (4) Date: Feb. 23, 2005

(87) PCT Pub. No.: WO03/075406

PCT Pub. Date: Sep. 12, 2003

(65) Prior Publication Data

US 2005/0174288 A1 Aug. 11, 2005

(51) Int. Cl.
*H01Q 1/38* (2006.01)

(52) U.S. Cl. ..... 343/700 MS; 343/853

(58) Field of Classification Search ..... 343/700 MS, 343/853, 846

See application file for complete search history.

(56) References Cited

U.S. PATENT DOCUMENTS

| | | | | |
|---|---|---|---|---|
| 4,816,835 | A * | 3/1989 | Abiko et al. | 373/700 MS |
| 4,926,189 | A * | 5/1990 | Zaghloul et al. | 343/700 MS |
| 4,929,959 | A * | 5/1990 | Sorbello et al. | 343/700 MS |
| 4,963,892 | A | 10/1990 | Matsuo | |
| 5,510,803 | A | 4/1996 | Ishizaka | |
| 5,661,494 | A | 8/1997 | Bondyopadhyay | |
| 5,959,588 | A | 9/1999 | Johannisson | |
| 6,456,241 | B1 | 9/2002 | Rothe | |

FOREIGN PATENT DOCUMENTS

| | | |
|---|---|---|
| EP | 0301580 | 2/1989 |
| EP | 034545 | 12/1989 |
| EP | 0377999 | 7/1990 |
| EP | 0383597 | 8/1990 |
| WO | WO 98/26642 | 6/1998 |

* cited by examiner

*Primary Examiner*—Tan Ho
(74) *Attorney, Agent, or Firm*—Christian D. Abel

(57) ABSTRACT

A flat antenna for receiving digital or analogue broadcasts from a satellite, comprising at least one layer of individual receiver elements, the elements in the layer being interconnected by means of conductive paths in such a manner that the signal's phase shift owing to the position of the elements in the layer is compensated for by means of length variations in the conductive paths, where the individual receiver elements are connected in pairs to a pair collector point, the pairs are connected into sub-arrays with a sub-array collector point, the sub-arrays are connected into arrays with an array collector point, and the arrays are connected into groups with a group collector point. According to the invention the conductive paths between elements, pairs, sub-arrays, arrays and/or groups comprise one or more of the following elements: straight segments extending in a first direction, straight segments extending in a second direction perpendicular to the first direction, straight segments extending on a third direction inclined or angled in relation to the first and the second directions and bent segments or compensation leads, wherein the bent segments comprise two or more straight parts and/or one or more curved parts. The antenna comprises also reflector elements lying perpendicular to the antenna's plan dimensioned and positioned in such a way that the received signal level is considerably enhanced through constructive interference.

12 Claims, 8 Drawing Sheets

VERTICALLY-ORIENTED SATELLITE ANTENNA

CROSS-REFERENCE TO RELATED APPLICATION

This application is a National Stage filing under 35 USC §371 of PCT/NO02/00092, filed Mar. 6, 2002.

BACKGROUND OF THE INVENTION

1. Field of the Invention

The present invention relates to satellite antennas, more specifically a satellite antenna capable of substantially vertical orientation.

2. Description of Related Art

There is a plethora of inventions related to microstrip lines generally and specially microstrip (also often called patch) antenna. Recent inventions relate to additional modules external to the patch antenna itself.

There is a plethora of inventions related to microstrip lines generally and specially microstrip (also often called patch) antenna. Recent inventions relate to additional modules external to the patch antenna itself.

Either some external modules are added to existing microstrip antenna device based on prior art technology or some additional active devices are included such as biasing of semiconductor substrates.

The present invention is based on the following strategies:

(1) User friendliness meaning easy mounting and "plug and play" approach, so that any layman can handle the mounting of the antenna and connection to any commercially available tuner without much technical effort.

(2) Minimising the cost of production as much as possible, incorporating commonly available materials, which are amenable for processing in the production of microstrip antenna and the associated substrates and conducting materials.

With these two main points under focus, the technique described in this invention is based on inclusion of microstrip structures on the plane of the patch antenna itself and reinforcement of received signals using constructive interference based on positioning of reflectors on the plane of the patch antenna.

The present invention relates to a flat antenna for receiving digital or analogue signals from a satellite, arranged to be located in a substantially vertical position so that the antenna has an acute inclination angle with respect to the satellite's beam direction.

Conventional flat antennae need to be in a position such that the inclination angle with respect to the satellite's beam direction is 90 degrees. As the satellite's beam direction is seldom horizontal, these antennae cannot be mounted vertically.

A normal antenna includes conductive elements (receiving units in the form of patches) arranged in various topologies of rows and columns and a network of signal feed circuits interconnecting these elements. Part of the signal feed circuit usually has microstrip structures to compensate for phase delays in receiving the incoming radiation by these elements. The feed circuit geometry as a whole is designed in such a way that the signals received by selected groups of elements have the same phase before they are added together to provide a final output signal.

U.S. Pat. No. 4,963,892 shows a microwave plane antenna for receiving circularly polarized waves. This antenna comprises conductive antenna elements and conductive paths connecting the elements together.

The conductive paths which connect the elements have different lengths so that the main beam direction can be set in a plane including that of the antenna.

U.S. Pat. No. 5,661,494 describes a microstrip antenna for radiating circularly polarized electromagnetic waves comprising radiator elements with coplanar dual orthogonal microstrip feeds. The conductive paths in this antenna have again different lengths for phase compensation. If this antenna is to be used as a receiver, the plane containing the elements of the antenna should be perpendicular to the incoming radiation to obtain a satisfactory gain.

BRIEF SUMMARY OF THE INVENTION

The antenna according to the invention is specially adapted for vertical or almost vertical positioning. This is achieved by providing conductive paths between receiving elements comprising straight segments extending in a first direction, straight segments extending in a second direction perpendicular to the first direction, straight segments extending along a third direction inclined or at an angle with respect to the first and the second directions (also called slanted segments) and bent segments or compensation leads (these segments comprise two or more polygonal sections and/or one or more curvilinear sections). This combination of signal transmission paths leads to considerable improvement in the level of received signal and makes it possible to receive satellite signals in a wide range of inclination angles with the antenna positioned vertically.

The technique used to compensate for phase delays in signals of each element in a group, when the antenna is mounted vertically, is based on compensating for the signal delays in each group and element by using the slanted and the bent segments. The combination of these two conducting paths, helps to receive satellite broadcasting without any loss in signal quality, even though the antenna surface is not perpendicular to the wave fronts coming from the satellite.

Only with the bent and the slanted segments in the topology of the antenna, the antenna could be mounted vertically. Either of these connectors alone in the antenna topology, does not help reception of signals form the satellite, with the antenna mounted vertically.

The antenna according to the invention comprises individual receiver elements grouped in pairs, the pairs forming sub-arrays, the sub-arrays forming arrays and these forming groups. The conductive elements forming a pair are connected to a common point defined hereby as pair collector. The same applies for the sub-arrays, arrays and groups, where the pairs, sub-arrays and arrays will be connected to sub-array, array, and group collectors respectively.

The invention will more specifically comprise a flat antenna for receiving digital or analogue broadcasts from a satellite, comprising at least one layer of individual receiver elements, the elements in each layer being interconnected by means of conductive paths in such a manner that the signal's phase shift owing to the position of the elements in the layer is compensated for by means of length variations in the conductive paths, where the individual receiver elements are connected in pairs to a pair collector point, the pairs are connected into sub-arrays with a sub-array collector point, the sub-arrays are connected into arrays with an array collector point, and the arrays are connected into groups with a group collector point. The invention is characterized in that the conductive paths between elements, pairs, sub-arrays, arrays and/or groups comprise one or more of the following elements: straight segments extending in a first direction, straight segments extending in a second direction perpendicular to the first direction, straight segments extending on a third direction inclined or at an angle with respect to the first and the second directions and bent segments or compensation leads, wherein the bent segments comprise two or more straight parts and/or one or more curved parts. Each receiving element has only one feed line.

In one embodiment of the invention, each pair of elements comprises one straight segment extending in the third direction or slanted segments, that is at least one element in a pair is connected to the pair collector by means of at least one straight segment extending in the third direction. In a preferred version of this embodiment each group comprises one compensation lead, that is at least one array in a group is connected to a group collector by means of a bent or curved segment. Such segments could also be formed as meander lines.

In one embodiment the antenna is equipped with reflectors which enhance the level of the received signal considerably, by proper dimensioning of the size of the reflectors and their locations. In this embodiment the antenna is equipped with reflectors for every antenna element, the reflectors being normal to the plane of the antenna. The reflectors main task is to reflect the incident wave in such a manner that the reflected waves fall in the elements above each reflector and lead to constructive interference in all these elements, thus leading to an improved signal level at the signal pick-up point in the middle of the antenna. The reflectors can have design variations with perforations in the middle or at the edge of the reflectors to permit passage of radiation through the reflectors to those elements underneath them, so that the direct incidence of waves on each element is sustained. The reflectors can also be constructed as a single reflector for each element or grouped in a strip.

The advantage of the invention is that the antenna will preferably be placed vertically, being set at a specific inclination angle during production (the angle is dependent on the degree of latitude of the place of use and of the incoming radiation direction, e.g. in Oslo, Norway this angle is approximately 22 degrees for the most common satellites). A large tolerance may be allowed for on the elevation (approximately 5 degrees plus). The consequence is that an antenna produced for optimal operation at a specific latitude will still give satisfactory results at other latitudes. On the other hand, the aperture angle on azimuth is narrower than 3 degrees. This means that placement and adjustment of the antenna will only comprise rotating it about a vertical axis until a useful signal level is received. This represents a substantial simplification of the installation process. The installation can thus be performed by an unskilled person.

Due to the low aperture angle, interference resulting from waves from satellites in close proximity to one another will be avoided. The antenna, moreover, will not occupy unnecessary space and no dirt, snow, etc will accumulate on the surface of the antenna.

In the antenna according to the invention the phase shift between the signals received by the various elements, as a result of different arrival times for the signals, is compensated for, while signal loss due to impedance mismatch introduced by the compensation devices, is kept as low as possible.

According to the invention the length variations in the conductive paths for connecting the receiver elements, sub-arrays, arrays, and/or groups are implemented in the form of bent segments and/or straight paths that can extend along a first, a second or a third, inclined direction. This will also lead to minimisation of the loss of signal level due to impedance mismatch in the microstrip circuits. In a special embodiment of the invention, angled, straight paths are used for connecting elements and loop links for connecting the sub-arrays, but other combinations are also possible.

The antenna comprises two different dielectric substrates with receiver elements, one for receiving horizontally polarised signals and the other for receiving vertically polarised signals. Each of these two layers has conductive paths formed as described above.

Each substrate with the conductive paths and elements has a network of signal delay networks and transmission paths with a mirror symmetry along a line running across the middle of the antenna section, leading to the centre to an air gap at which the signal will be coupled to the LNB (Low Noise Block Converter) using established techniques as found in other antennas meant for reception of satellite program transmissions. These phase compensating lines could also be formed in the form of meander lines.

The antenna also comprises a sheet with holes, the width of the holes being between 12 mm and 15 mm. The size of the holes is selected to suit the frequency band of operation and to optimise the level of the signal and improve the signal to noise ratio. The geometrical form of the holes can also vary.

In an embodiment the antenna is in the form of a long strip, the main reason for this being that it will be aesthetically more pleasing. In addition a long, narrow antenna, which is in a perpendicular upright position, will be able to alternate between different satellites by means of simple automatic adjustments, which will lead to the desired angular displacement.

Although the different features of the antenna according to the invention, as the compensating microstrip elements shown in FIG. 6, presence of reflectors, presence of a signal pick-up point with a gap, design variation involving a long strip of antenna array, have been presented as independent embodiments of the invention, an embodiment comprising a combination of all or some of the above-mentioned features is also feasible within the scope of the invention.

BRIEF DESCRIPTION OF THE DRAWINGS

The invention will now be explained by means of an embodiment, which is illustrated in the drawings. The example is not intended to be considered limiting and other combinations of elements will naturally lie within the scope of the invention. The drawings are as follows.

DETAILED DESCRIPTION OF INVENTION

Figure 1:
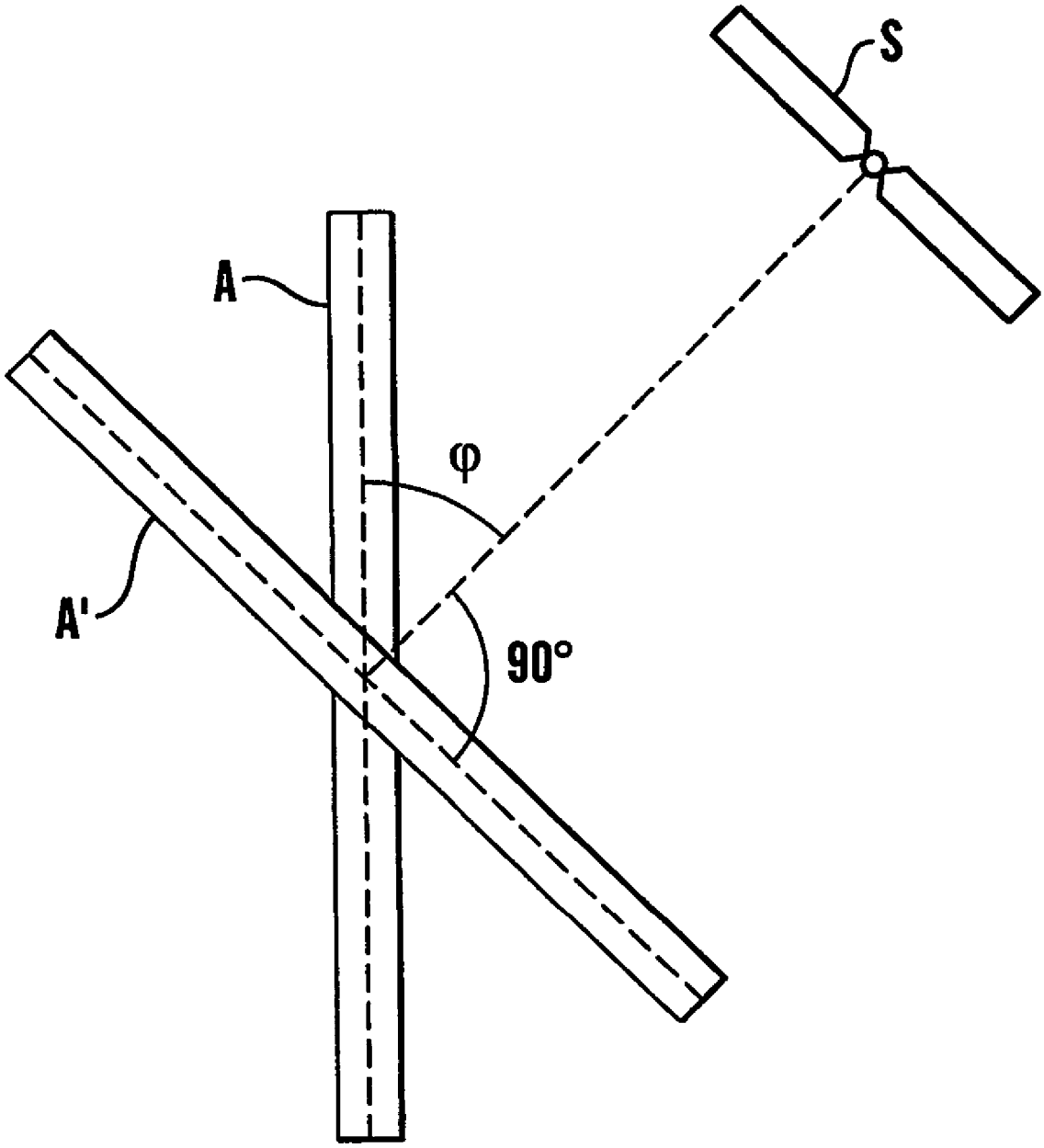
FIG. 1 illustrates the relative positioning of an antenna A according to the invention and of an antenna A' according to the prior art in relation to a satellite beam.

FIG. 1 illustrates the relative positioning of an antenna A according to the invention in relation to an incoming wave from a satellite S. The antenna A according to the invention permits vertical or almost vertical positioning (5 degrees plus from the vertical direction will still give a satisfactory signal), and the inclination angle Φ will be less than 90 degrees. An antenna A' according to the prior art will be situated at 90 degrees to the incoming wave.

Figure 2:
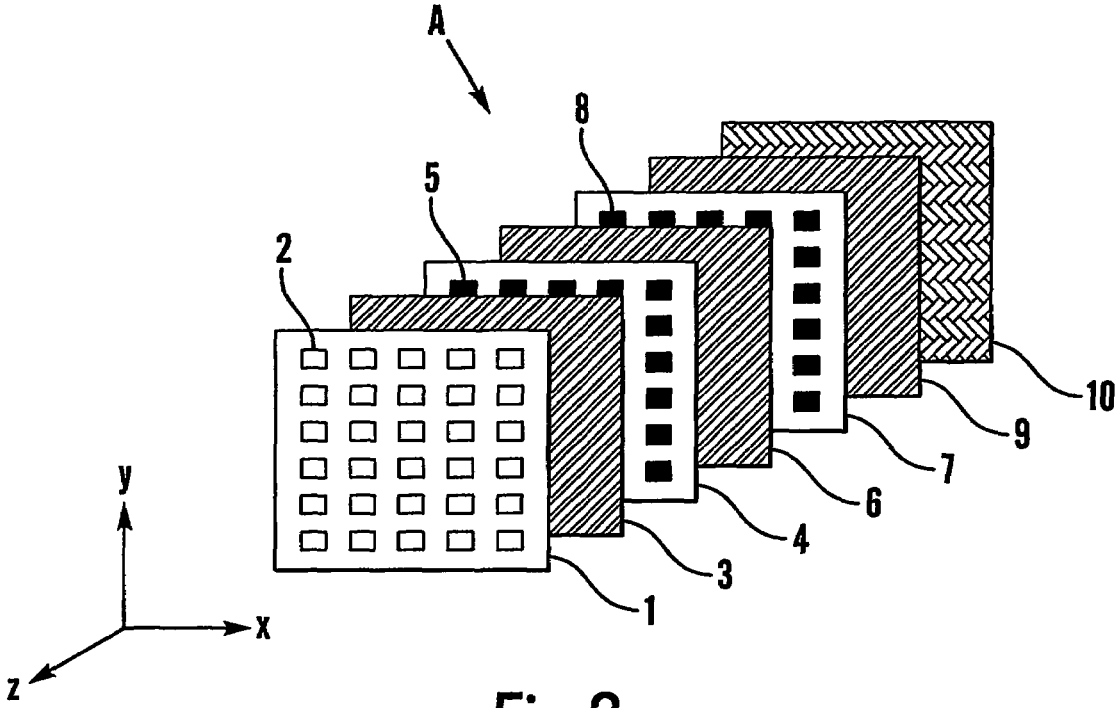
FIG. 2 illustrates a first embodiment of the antenna according to the invention in an exploded view.

FIG. 2 illustrates a first embodiment of the invention in an exploded view. The antenna A comprises: a sheet with holes or front cover 1, the front cover 1 comprising holes 2 for wave propagation, a first spacer or isolation plate 3, a first conductive element layer 4 comprising elements 5, a second spacer plate 6, a second conductive element layer 7 comprising elements 8, a third spacer plate 9 and an earth plane plate 10.

The first layer is a sheet of conductor 1 with holes 2. In an embodiment of the invention this sheet has 16×16 holes minus 4 in the middle, which have been removed, and in a second embodiment it has 8×32 holes. It is possible to vary the number of holes 2 according to requirements (signal strength, etc.), thus enabling the antenna to be made both larger or smaller than the one shown in FIG. 1.

The layer 3 is a suitable dielectric material which functions as a spacer between the two conducting layers 1 and 4, at the same time enabling the transmission of the incoming wave from the satellite to the layers below as shown in FIGS. 1 and 2.

The first conductive element layer 4 is arranged to receive vertically polarised signals, and is composed of a film containing conductive elements 5, which will be discussed in more detail later.

Between the first conductive element layer 4 and the second conductive element layer 7 a second spacer plate 6 is placed. The function of the second spacer plate 6 is to provide a medium of isolation between the conductive layers 4 and 7 and suitable dielectric constant enabling the transmission of waves.

The second conductive element layer 7 comprises antenna elements 8 for receiving horizontally polarised signals.

The function of the third spacer plate 3 is also to provide a medium of isolation between the conductive layers 7 and 10 and suitable dielectric constant enabling the transmission of waves.

This special construction according to the present invention makes it possible to mount the antenna vertical without impairing the received signal quality.

This property is a consequence of the following features of the antenna: extension of the conductive path between the individual elements in pairs in order to phase-shift the signal from the upper elements so that they will be in phase with the lower ones (where "lower" and "upper" refer to the vertical direction), use of bent segments, use of reflectors (which are preferably at 90 degrees but which may be arranged at another angle) which increase the signal strength of the antenna, and use of narrow cell holes 2 whose primary function is to reduce noise. It is important to point out that although the presence of all these features will lead to a satisfactory result, an antenna that comprises only some of these elements in different combinations will also be functional.

Figure 3:
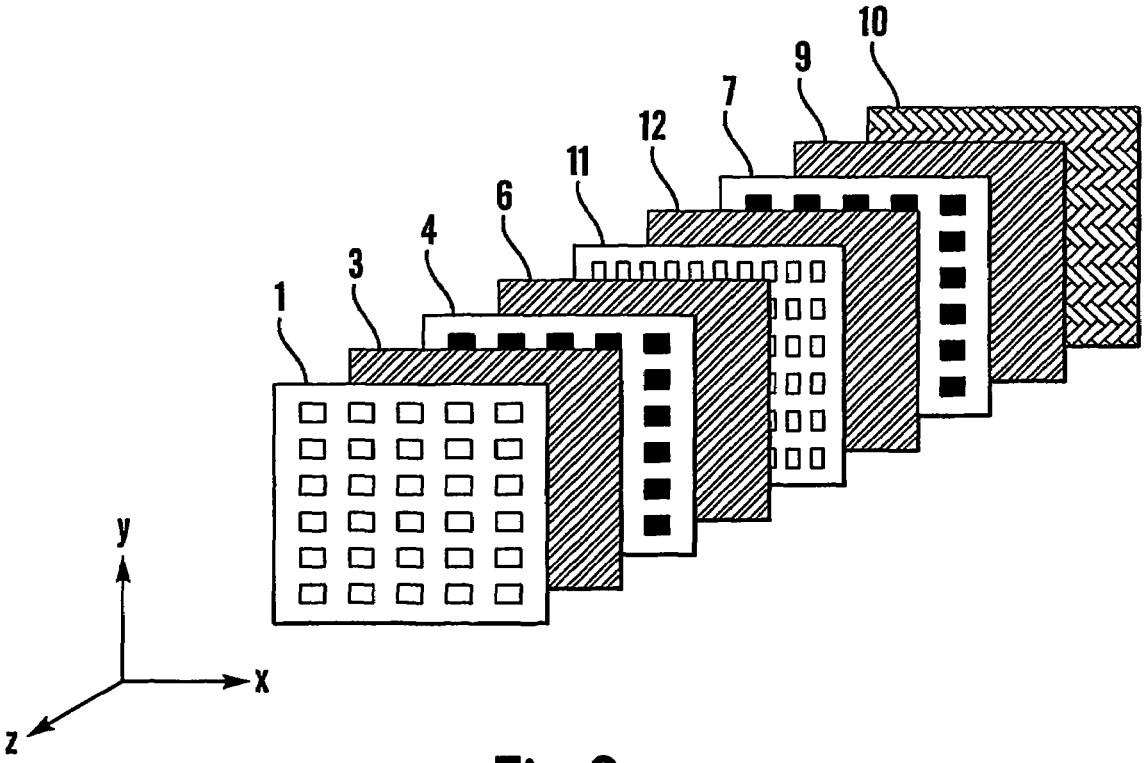
FIG. 3 illustrates a second embodiment of the antenna according to the invention in an exploded view.

FIG. 3 illustrates a second embodiment of the antenna according to the invention in an exploded view. In this embodiment a further conductive layer 11 with holes is provided together with another isolating or spacer layer 12. The function of this conductive layer 11 with holes can be explained through the theory of slot coupling between microstrip elements and slot in the earth conductor.

Figure 4:
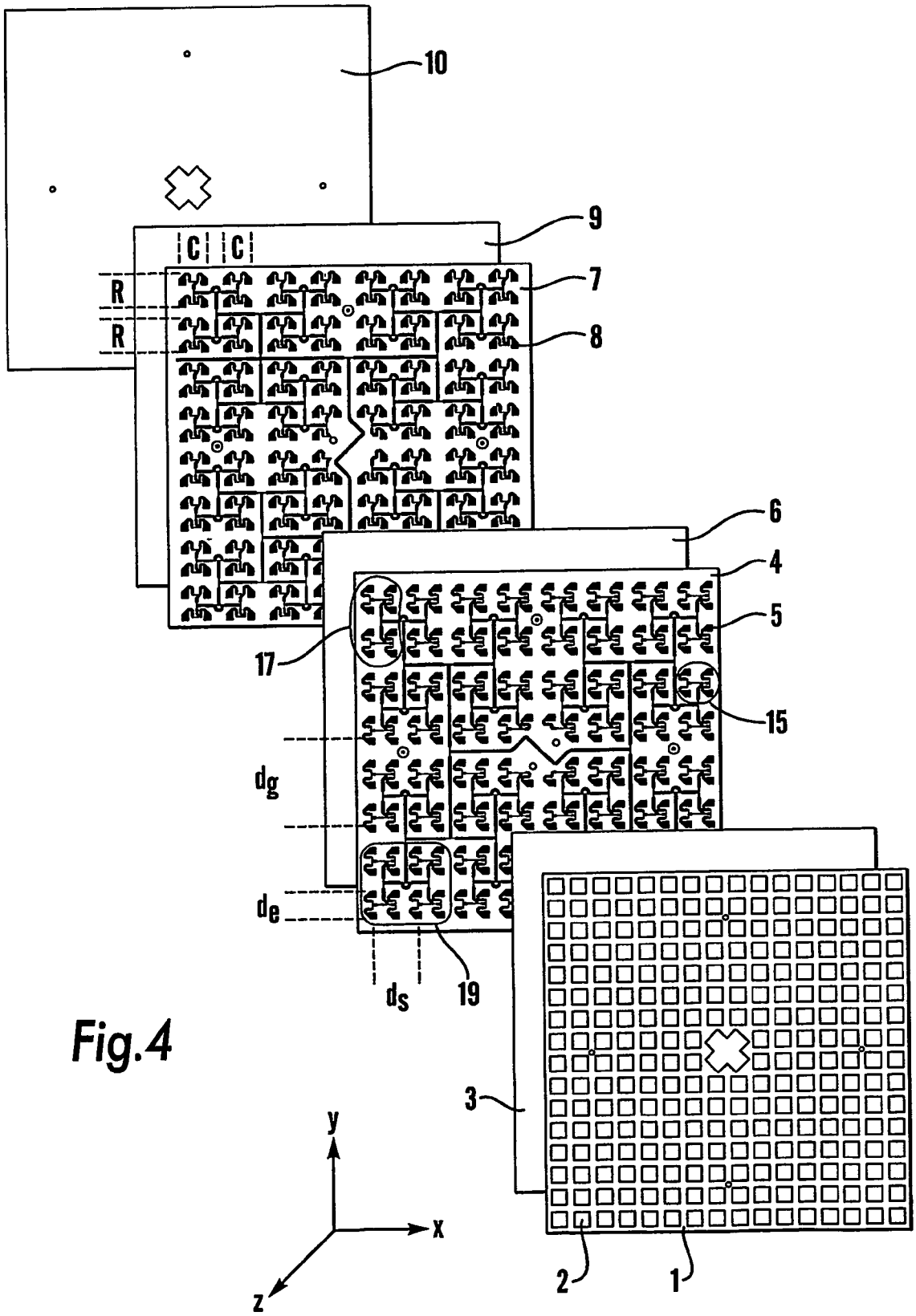
FIG. 4 illustrates the position of the horizontal and the vertical polarisation layers in one embodiment of the antenna according to the invention.

FIG. 4 illustrates more precisely the general arrangement of conductive elements 5 and 8 in the conductive layers for vertically polarised signals 4 and for horizontally polarised signals 7 in the first embodiment of the antenna according to the invention as shown in FIG. 2.

Figure 5:
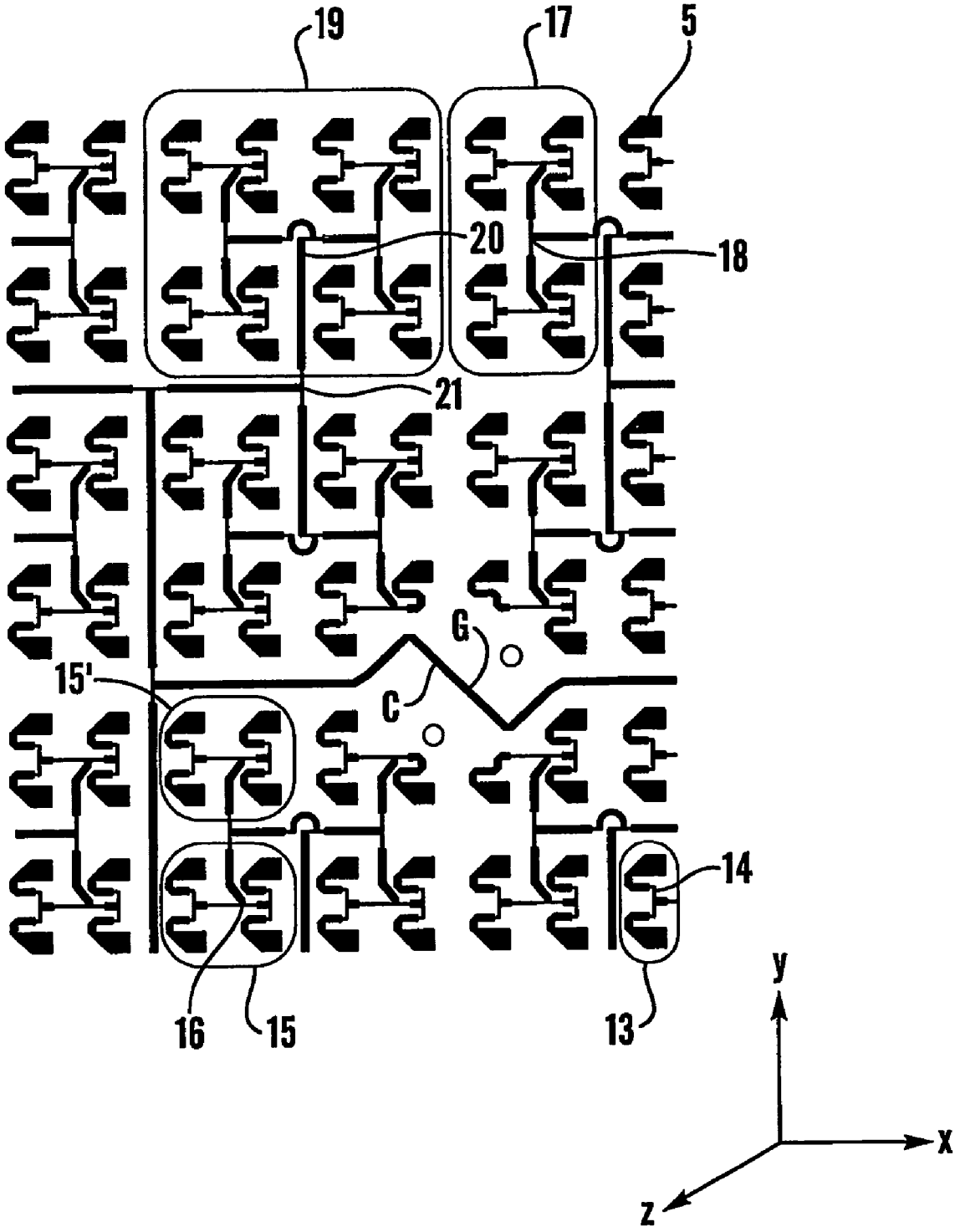
FIG. 5 illustrates a conductive element layer with an air gap, conductive elements, sub-arrays and groups.

FIG. 5 illustrates the first conductive path layer 4, which is arranged for receiving vertically polarised signals. Layer 4 comprises conductive receiving antenna elements 5, which are connected in pairs 13 to a pair collector point 14, the pairs 13 are connected into sub-arrays 15 to a sub-array collector point 16, the sub-arrays 15 are connected into arrays 17 to an array collector point 18, and the arrays are connected into groups 19 to a group collector point 20. Two groups 19 are connected to each other at a two-group collector point 21 and so on.

The second conductive path layer 7 has a similar structure containing elements, pairs, sub-arrays, arrays and groups.

The elements 5 and the sub-arrays 15 are interconnected by means of conductive paths, and it has been shown to be particularly advantageous with regard to loss due to impedance mismatch to arrange the paths as illustrated in the figure, viz. with straight segments along a first or a second direction x or y between the elements 5 and with bent segments or compensation leads between the 8-element arrays. In the shown embodiment the conductive paths between groups 19 comprise only segments along the first and the second direction.

The antenna A according to the invention comprises in an embodiment four-element sub-arrays 15 and four columns and four rows of interconnected sub-arrays 15, containing four groups 19 of four sub-arrays 15 as shown in FIG. 5. The number of elements in the sub-array 15 $n_s$ and number of groups 19 $n_g$ can be selected to suit the applications. Similarly, the number of columns ($n_c$) and the number of rows ($n_r$) containing the groups can also be varied to suit the application. The shape of each conductive element (5, 8) is selected to match the polarisation, being vertically and horizontally oriented for vertical and horizontal polarisation respectively. In the embodiment described with reference to FIGS. 4 and 5 the characteristic numbers are as follows:

Number of elements in the sub-array ($n_s$) 4
Number of groups ($n_g$) 4
Number of columns ($n_c$) 4
Number of rows ($n_r$) 4
Number of elements ($n_e$) 16×16−4=252

The art of coupling the conductive elements (5, 8) in the sub-array 15 and the sub-arrays 15 in the group 19 and placing the groups 19 in the rows and columns is based on partly established antenna theory for achieving constructive interference to get maximum signal at the receiving point in the middle of the complete antenna configuration as shown in FIG. 4, in which the antenna coupling to the receiver LNB (Low Noise Block Converter) is achieved via a field coupling mechanism placed optimally in the vicinity of the gap between the striplines, and on a plethora of series of trials and errors in construction, tests and modifications that led to the present state of the antenna according to the invention.

The explanations given as theoretical basis in the description of this invention hence serve to describe the main principle of operation.

Generally, we can write the following equations, $$n_e = n_g n_s n_c n_r - 4$$

As shown in FIG. 5, the distance between elements in the sub-array $d_e$ and the distance between sub-arrays $d_s$ the distance between groups $d_g$ are all selected to enhance the level of constructive interference needed for the optimal performance of the antenna in the frequency range 10.75 GHz–12.75 GHz.

A closer look into the design of the antenna as shown in FIG. 4 shows very important variations of otherwise very linear streamlined patterns of the elements 5, 8, sub-arrays 15, groups 19, columns (C) and rows (R). The connection between the sub-arrays 15 is achieved using conductive paths or striplines of suitable length with one segment along a third direction pointing downwards (towards−y) to the horizontal for both the layers of antenna meant for reception of vertically (4) and horizontally (7) polarised transmissions. The connection between the pair of sub-arrays 15 in a group 19 is achieved by using curved or bent segments or striplines facilitating the right phase of the signals from the pair of sub-arrays 15 in a group 19.

The inclination angle with respect to the transmitting satellite S (FIG. 1) being depicted by Φ, we find both from measurements and theory, that the distance between rows $d_r$ is equal to the distance between the groups $d_g$ and is given by $$d_r = d_g = d$$

$$d = \frac{\lambda}{\sin\varphi}$$

Figure 6:
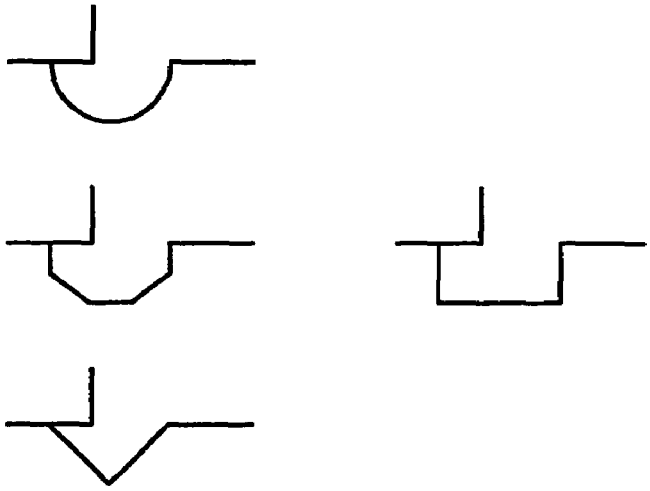
FIG. 6 illustrates bent or curved segments.

FIG. 6 illustrates bent or curved segments in different embodiments. As shown in the figure, the object of the bent or curved segments is to provide a conductive path that does not follow a straight line, and the shown geometries are advantageous for impedance compensation.

Both conductive element layers 4 and 7 are provided with collector elements. In an embodiment of the invention (FIG. 5) the collector elements C have a gap G out of which the total signal from all the elements in the layer will emerge. The signal will be received by a receiving head with an input for each layer (not shown in the figures), which preferably has a point facing the gap G. It is also possible to directly connect the receiving head, LNB (Low Noise Block Converter) to the antenna by a soldered connection. This will then replace the point and the gap but will not come into the same position, but will come in the middle of the path.

The receiver elements 5, 8 in the conductive element layers 4, 7 may have different shapes, and may be square, round, star-shaped, triangular, etc. In a preferred embodiment of the invention the elements are in the form of oblong squares.

The plate 10 is the earth plane used in any microstripline construction. As mentioned earlier, the horizontally and vertically polarised signals are picked up by a suitable set of LNBs When the two films with conductive elements are placed directly above each other as explained, the two gap apertures will be slightly displaced relative to each other. The choice of vertically or horizontally polarised signal is made with the help of LNBs and a suitable signal receiver (tuner).

Figure 7:
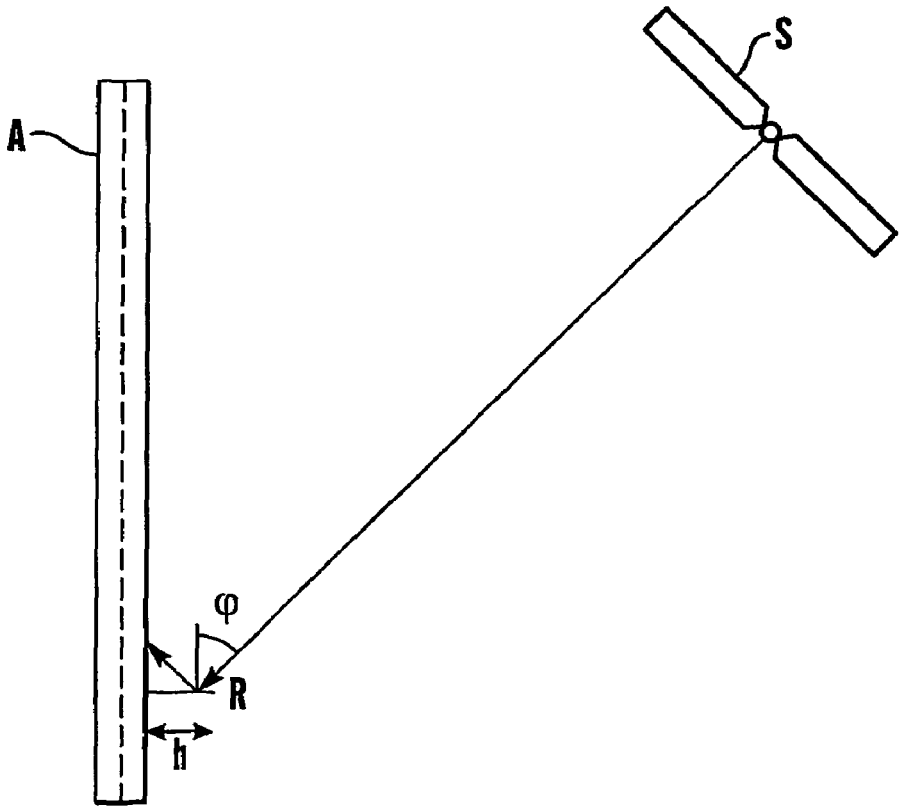
FIG. 7 shows the reflectors' function for reflectors without perforations.

With reference now to FIG. 7, an additional feature in the antenna A according to the invention is the incorporation of the reflector element R perpendicular to the plane of the antenna with a height h easily adjustable to suit the inclination angle Φ. In selected applications, to enhance the received signal, the reflector R may incorporate perforations P (FIG. 8), to facilitate transmission of the incoming waves from the satellite S reaching the elements (5, 8) without being blocked by the reflectors R. It is plausible to assume that the perforations function as new sources of waves just as in Huygen's wave theory. The principle of operation can be explained as follows.

Figure 8:
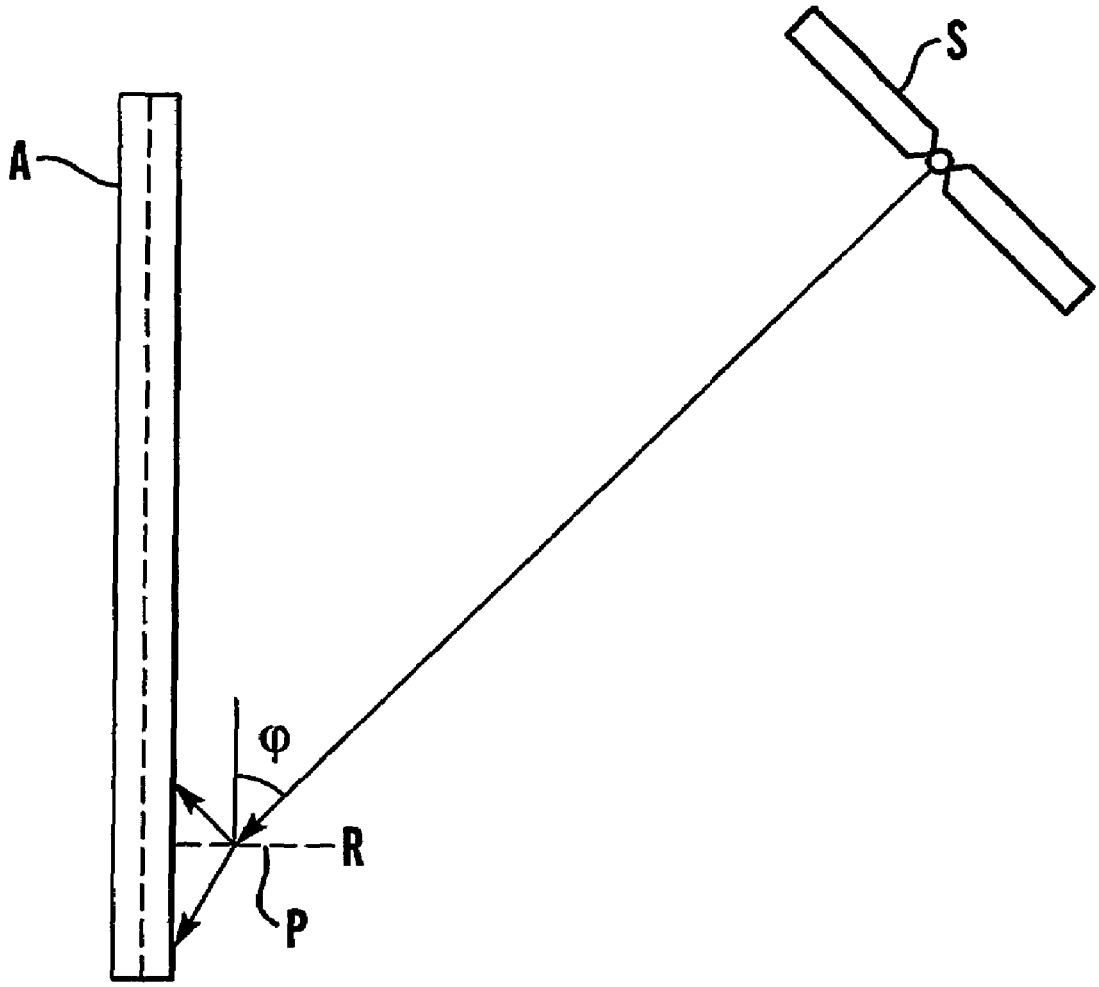
FIG. 8 shows the reflectors' function for reflectors with perforations.

The reflectors enhance the signal quality considerably. The perforations in the reflectors, help wave transmission to all elements, when the antenna is positioned at angle Φ to the vertical as shown in FIGS. 7 and 8. The reflector surfaces, act as additional sources, the phase of which has to be harmonised with the direct signals falling onto the elements of the patches. The maximum path covered by the reflected wave is h cosec Φ, the patch should be placed within a distance of h cot Φ. The wave leaving the reflector after reflection will be reaching the patch area after a maximum delay of h/c sin Φ. For the bandwidth of operation of the antenna, these values have to be taken into account in selecting the size of the patch and that of the reflector.

The receiving quality of the antenna with the plane of the antenna in vertical position is possible with the connecting lines as shown in FIGS. 4 and 6. The reflector is not necessary for the operation of the antenna with its plane positioned vertically, but enhances the received signal level.

Figure 9:
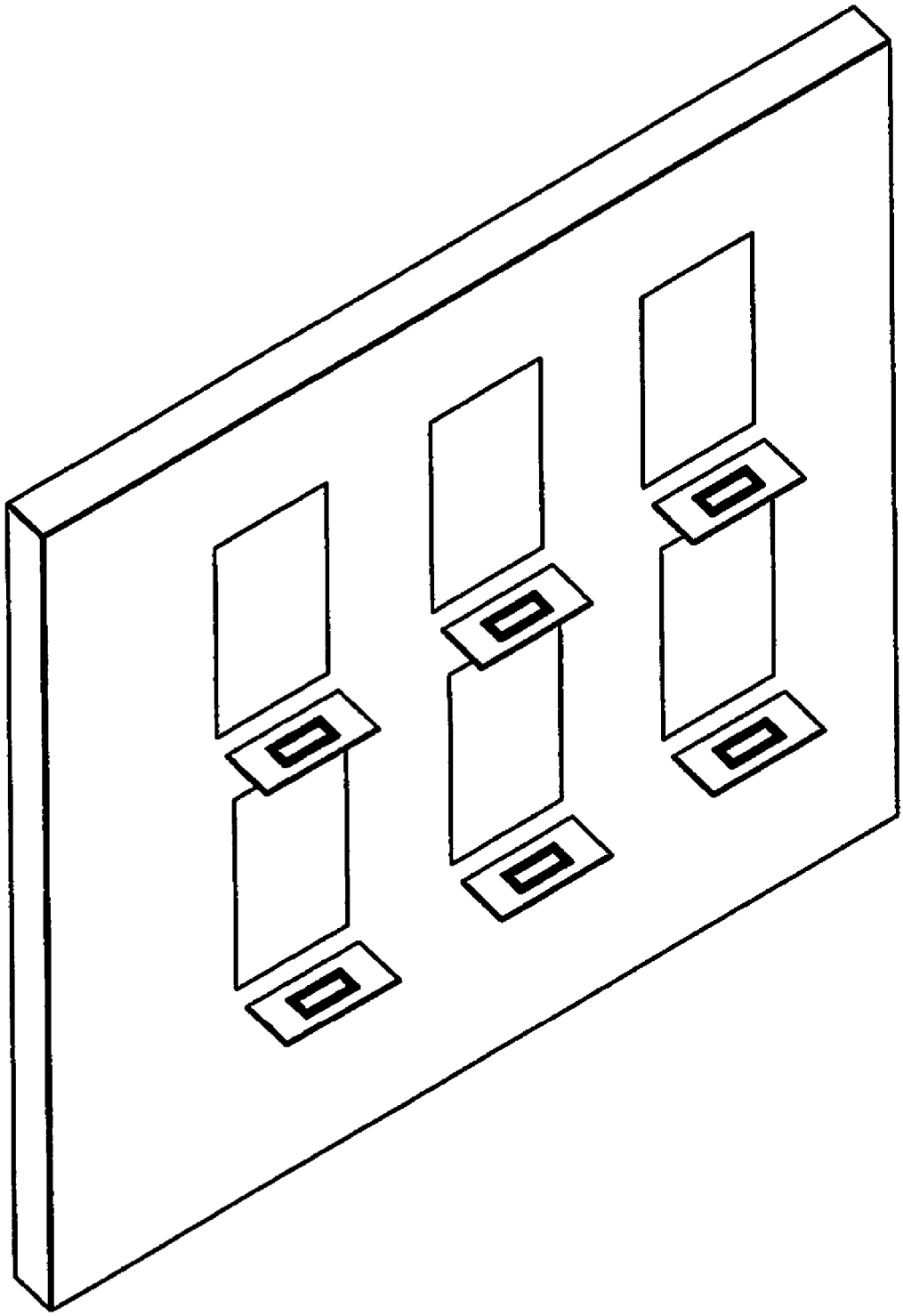
FIG. 9 shows one embodiment of the reflectors for each element or sub-array.
Figure 10:
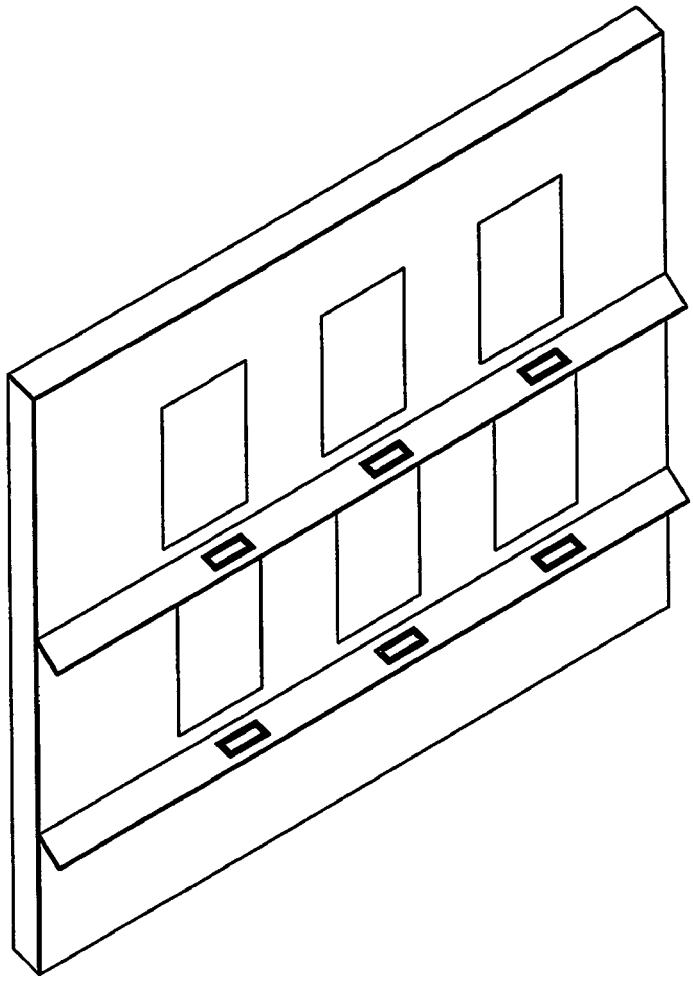
FIG. 10 shows another embodiment of the reflectors in the form of a continuous strip meant for all the elements or array in the same row.

FIGS. 9 and 10 show different embodiments of the reflectors formed as single reflectors (FIG. 9) or grouped in a strip (FIG. 10).

Figure 11:
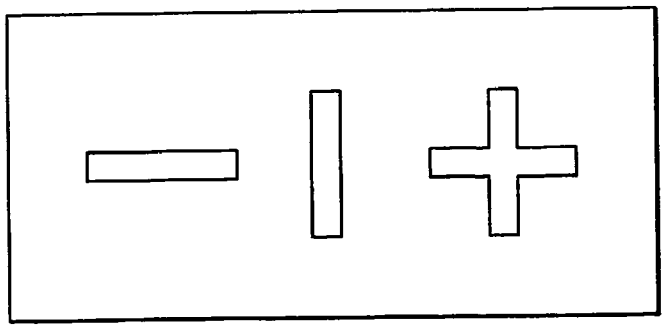
FIG. 11 shows possible geometries for reflector perforations. The perforations can be located right at the edge of the reflector leading to an opening at the edge.

FIG. 11 shows possible geometries for reflector perforations.

As stated before, the antenna according to the invention provides a simple answer to a long felt need by providing an easy to manufacture device which can be mounted on a vertical wall and tuned by an unskilled person.

The invention claimed is:

1. A flat antenna (A) for receiving digital or analogue broadcasts from a satellite (S), comprising at least one layer of individual receiver elements, the elements in the layer being interconnected by means of conductive paths in such a manner that the signal's phase shift due to the position of the elements in the layer is compensated for by means of length variations in the conductive paths, where the individual receiver elements are connected in pairs by means of conductive paths to a pair collector point, the pairs are connected by means of conductive paths into sub-arrays with a sub-array collector point, the sub-arrays are connected by means of conductive paths into arrays with an array collector point, and the arrays are connected by means of conductive paths into groups with a group collector point, where the conductive paths comprise at least one straight segment extending in a first direction and one straight segment extending in a second direction perpendicular to the first direction, characterized in that the conductive paths further comprise at least one straight segment extending on a third direction inclined or angled in relation to the first and the second directions or a bent segment comprising two or more polygonal sections and/or one or more curvilinear sections.

2. Antenna according to claim 1, characterized in that at least one sub-array (15) in anarray (17) is connected to the array collector (18) by means of at least one straight segment extending in the third direction.

3. Antenna according to any of the preceding claims,
characterized in that at least one array (17) in a group (19) is connected to a group collector (20) by means of a bent segment.

4. Antenna according to claim 1,
characterized in that it comprises layers of elements (8) for receiving horizontally polarised signals and layers of elements (5) for receiving vertically polarised signals.

5. Antenna according to claim 1,
characterized in that it comprises reflector elements (R) situated in an angle to the antenna plane, where this angle is preferably 90 degrees.

6. Antenna according to claim 5,
characterized in that it is equipped with individual reflectors (R) for the individual antenna elements (5,8).

7. Antenna according to claim 6,
characterized in that the individual reflectors (R) comprise perforations (P) where these perforations to facilitate transmission of the incoming waves from the satellite (S) reaching the elements (5, 8) without being blocked by the reflectors (R).

8. Antenna according to claim 5,
characterized in that it is equipped with a strip of reflectors (R) assigned to several elements.

9. Antenna according to claim 8,
characterized in that the strip of reflectors (R) comprise perforations (P) where these perforations to facilitate transmission of the incoming waves from the satellite (S) reaching the elements (5, 8) without being blocked by the strip of reflectors (R).

10. Antenna according to claim 1,
characterized in that each conductive element layer (4,7) comprises a collector element (C) for signals from all the antenna groups (19), and the collector element (C) consists of a conductive path with an air gap (G), where path length is different on both sides of the gap (G), and a receiving head for receiving signals from the gaps.

11. Antenna according to claim 1,
characterized in that it comprises a sheet (1) with holes (2), the width of the holes (2) being between 12 mm and 15 mm for the frequency band of operation.

12. An antenna according to claim 1,
characterized in that it is in the form of a strip.

* * * * *